US008371140B2

(12) United States Patent
Holmes et al.

(10) Patent No.: US 8,371,140 B2
(45) Date of Patent: Feb. 12, 2013

(54) REFRIGERATED CONTAINER FOR SUPER FROZEN TEMPERATURES

(75) Inventors: George A. Holmes, Boston, MA (US); B. Eric Graham, Hamilton, MA (US)

(73) Assignee: CWS Group LLC, Boston, MA (US)

( * ) Notice: Subject to any disclaimer, the term of this patent is extended or adjusted under 35 U.S.C. 154(b) by 821 days.

(21) Appl. No.: 12/350,630

(22) Filed: Jan. 8, 2009

(65) Prior Publication Data

US 2009/0183514 A1 Jul. 23, 2009

Related U.S. Application Data

(60) Provisional application No. 61/022,676, filed on Jan. 22, 2008, provisional application No. 61/089,290, filed on Aug. 15, 2008.

(51) Int. Cl.
*F25D 3/12* (2006.01)
*F17C 13/08* (2006.01)
*B60H 3/04* (2006.01)

(52) U.S. Cl. ..... 62/387; 62/53.2; 62/239

(58) Field of Classification Search ..... 62/410, 62/425, 388, 457.2, 385, 45.1, 50.3, 52.1, 62/53.2, 64, 66, 78, 165–168, 223, 239, 371–373, 62/383–384, 457.9, 603, 52.2, 387; 165/48.1, 165/61, 64, 222, 263

See application file for complete search history.

(56) References Cited

U.S. PATENT DOCUMENTS 3,561,226 A * 2/1971 Rubin ..... 62/66
3,695,056 A 10/1972 Glynn et al.
4,100,759 A * 7/1978 Tyree, Jr. ..... 62/50.1
4,399,658 A 8/1983 Nielsen
4,431,368 A * 2/1984 Katz et al. ..... 414/809
4,498,306 A * 2/1985 Tyree, Jr. ..... 62/119
4,502,293 A * 3/1985 Franklin, Jr. ..... 62/388
4,580,411 A 4/1986 Orfitelli
4,593,536 A * 6/1986 Fink et al. ..... 62/239
4,704,876 A 11/1987 Hill
4,761,969 A * 8/1988 Moe ..... 62/388
4,825,666 A 5/1989 Saia, III
4,891,954 A * 1/1990 Thomsen ..... 62/239
4,947,658 A 8/1990 Wheeler et al.
4,991,402 A 2/1991 Saia, III
5,125,237 A * 6/1992 Saia et al. ..... 62/239
5,152,155 A 10/1992 Shea et al.

(Continued)

FOREIGN PATENT DOCUMENTS

JP S 51-48008 4/1951
JP 2000-193354 7/2000

(Continued)

*Primary Examiner* — Frantz Jules
*Assistant Examiner* — Emmanuel Duke
(74) *Attorney, Agent, or Firm* — Sampson & Associates, P.C.

(57) ABSTRACT

A refrigerated container and method capable of maintaining super frozen temperatures of about−50 degrees C. or less, includes container walls insulated to a value of at least about r-20, a cargo compartment configured for receiving cargo, and at least one refrigerant compartment configured for receiving refrigerant in the form of $CO_2$ snow. The refrigerant compartment maintains the $CO_2$ snow and vapor sublimating therefrom separately from the cargo compartment. The refrigerant compartment is located within the cargo compartment and configured to permit ambient atmosphere within the cargo compartment to contact at least three sides, and up to six sides, of the refrigerant compartment. The placement of the refrigerant compartment is also configured to generate a temperature gradient within the cargo compartment capable of generating convection therein, so that the super frozen temperatures are maintained within the cargo compartment without the use of external power sources.

35 Claims, 7 Drawing Sheets

U.S. PATENT DOCUMENTS

| | | | | | |
|---|---|---|---|---|---|
| 5,320,167 | A | | 6/1994 | Johnson et al. | |
| 5,363,670 | A | * | 11/1994 | Bartilucci | 62/166 |
| 5,406,803 | A | | 4/1995 | Casto, II | |
| 5,415,009 | A | * | 5/1995 | Weiner et al. | 62/239 |
| 5,460,013 | A | * | 10/1995 | Thomsen | 62/239 |
| 5,598,713 | A | | 2/1997 | Bartilucci | |
| 5,638,697 | A | | 6/1997 | Reznikov et al. | |
| 5,660,057 | A | * | 8/1997 | Tyree, Jr. | 62/384 |
| 5,761,888 | A | * | 6/1998 | Haley | 53/502 |
| 5,787,719 | A | | 8/1998 | Wilson | |
| 5,791,150 | A | * | 8/1998 | Bosher et al. | 62/62 |
| 5,979,173 | A | * | 11/1999 | Tyree | 62/388 |
| 6,003,322 | A | * | 12/1999 | Graham | 62/52.1 |
| 6,615,908 | B1 | * | 9/2003 | Bosher et al. | 165/48.1 |
| 6,758,057 | B2 | * | 7/2004 | Vince et al. | 62/434 |
| 6,789,391 | B2 | * | 9/2004 | Graham et al. | 62/52.1 |
| 2003/0041601 | A1 | | 3/2003 | Graham et al. | |

FOREIGN PATENT DOCUMENTS

| | | |
|---|---|---|
| JP | 2001-520151 | 10/2001 |

* cited by examiner

REFRIGERATED CONTAINER FOR SUPER FROZEN TEMPERATURES

RELATED APPLICATION

This application claims priority to U.S. Provisional Application No. 61/022,676, entitled Refrigerated Shipping and Storage Containers, filed Jan. 22, 2008 and U.S. Provisional Application No. 61/089,290, entitled Refrigerated Shipping and Storage Containers, filed Aug. 15, 2008.

This application is also related to commonly owned U.S. Pat. No. 6,003,322, entitled Method and Apparatus for Shipping Super Frozen Materials, issued on Dec. 21, 1999, the contents of which are incorporated herein by reference in their entirety for all purposes.

BACKGROUND

1. Technical Field

This invention relates to a method and apparatus for shipping, storing and freezing super frozen perishable materials in a self-contained container which maintains the perishable material below −50 degrees C. using its own cryogenic-based refrigeration system.

2. Background Information

Commercial fishing is a worldwide enterprise generating billions of dollars in sales on an annual basis. With modern shipping and storage technology, fish caught nearly anywhere in the world can be efficiently frozen and subsequently transported to almost any market in the world for consumption thereof.

Particular products however, do not lend themselves to conventional freezing and shipping methods. In particular, fish intended for consumption in an uncooked or raw state such as sushi, generally cannot be frozen using conventional equipment, without adversely affecting the quality, i.e., color and taste thereof. For this reason, fish intended for use as sushi generally must be caught locally so it can be brought to market relatively quickly without freezing. This necessity has tended to limit the supply of fish available for sushi to effectively increase the price thereof relative to frozen fish. This phenomenon tends to produce a relatively large disparity between the price of sushi-grade fish and non-sushi grade (i.e., frozen) fish in the marketplace.

In a recent attempt to address this disparity, some commercial fishing enterprises have harvested fish, such as tuna and the like, in areas of the world where there is little local demand for sushi-grade product (and thus a substantially lower market value therefor), and transported the product at cryogenic (i.e., super-cooled) temperatures of less than −40 degrees C. to the sushi markets. It has been found that at these temperatures tuna and the like maintain suitable freshness for sushi purposes to thus retain the relatively high quality and premium prices associated with sushi-grade product. This approach has generally required dedicated use of cargo ships known as super carrier vessels, outfitted with specialized refrigeration equipment specifically designed to maintain a constant cryogenic temperature of about −60 degrees C. The expense of such vessels typically dictates their use only when a substantially full shipment of approximately 100 metric tons (100,000 kilograms) or more of product is available for shipment. Accordingly, in order to satisfy this relatively high minimum volume requirement, such ships must generally remain at port or in the vicinity of tuna fishing fleets for extended periods of time as the fish are harvested and prepared for shipment. Disadvantageously, this aspect generally limits the number of trips from the fishing ports to the sushi markets to approximately one or two trips per year. For many perishable products this high volume requirement and low trip frequency renders this approach impractical. For many products which are in demand, the time required for shipment on a super carrier vessel, often several months from harvest to arrival at the destination, further makes such a shipping method undesirable.

Smaller shipments of conventionally frozen (i.e., 0 to −26 degrees C.) product have been shipped utilizing standard ISO containers on conventional transport ships. These ISO containers are relatively plentiful and the conventional transport ships travel on a relatively frequent basis to most desired destinations. These containers are typically refrigerated by use of mechanical refrigeration units associated with each individual ISO container. These refrigeration units, however, have not been capable of providing refrigerated temperatures of less than about −25 degrees C. Moreover, such mechanical units are prone to mechanical failure, in which about 5 to 10 percent of shipments are lost due to spoilage primarily due to mechanical breakdown and human error. Such units are also relatively expensive, generally costing on the order of $8000 to $10,000 for the container, an additional $10,000 to $12,000 for each refrigeration unit plus another $10,000 to $12,000 for an electric generator (i.e., genset) to provide electric power for the refrigeration unit. A further drawback of these mechanically refrigerated containers is that they generally must be transported on ships equipped for "reefer" (i.e., refrigerated) shipments, i.e., on ships capable of providing a continuous supply of fuel and/or electricity to the containers and including technicians capable of servicing the units in the event of a failure en-route. Shipping rates for such reefer containers tend to be considerably higher than rates for "dry" containers (i.e., those not requiring such services) of comparable size and weight.

Other conventional refrigerated transportation devices include ISO containers which are filled with product and injected with liquid gas (such as $CO_2$) to form dry ice which maintains the product in a frozen state for the duration of the transport. A drawback of this approach, is that most such containers have generally been unable to maintain product at the aforementioned cryogenic, super-frozen temperatures. Rather, such containers, which utilize $CO_2$ and the like, have been used to ship standard frozen products which only require refrigeration to approximately −10 degrees C. Although the dry ice has a frozen temperature of approximately−50 to −60 degrees C., such containers generally provide an oscillating temperature environment during shipment. For example, fresh product is typically loaded into a container and liquid $CO_2$ is then injected to form dry ice at about −78 degrees C. at sea level. The dry ice thus gradually freezes the product bringing the product temperature from ambient temperature down to about−40 to −50 degrees C. until the $CO_2$ has sublimated at which time the product begins to increase in temperature during transport. The duration of the shipment is timed so that the container arrives at the destination before the product temperature exceeds about −10 degrees C. This approach thus provides an oscillatory, rather than the desired steady state shipment temperature.

Examples of such devices include Carbon Dioxide Refrigeration Systems (U.S. Pat. No. 3,695,056: Glynn; E. P. and Hsu; H. L.), Refrigeration system with carbon dioxide injector (U.S. Pat. No. 4,399,658: Nielsen; D. M.), Container $CO_2$ cooling system (U.S. Pat. No. 4,502,293: Franklin Jr.; P. R.), Liquid nitrogen freezer (U.S. Pat. No. 4,580,411: Orfitelli; J. S.), Portable self-contained cooler/freezer apparatus for use on common carrier type unrefrigerated truck lines and the like (U.S. Pat. No. 4,825,666: Saia, Ill; L. P.), Refrigerated container (U.S. Pat. No. 4,891,954: Thomsen; V. E.), Portable self-contained cooler/freezer apparatus for use on common carrier type unrefrigerated truck lines and the like (U.S. Pat. No. 4,991,402: Saia, III; L. P.), Portable self-contained cooler/freezer apparatus for use on airplanes, common carrier type unrefrigerated truck lines and the like (U.S. Pat. No. 5,125,237: Saia, III; L. P.), Self-contained cooler/freezer apparatus (U.S. Pat. No. 5,262,670: Bartilucci; A.), Portable self-contained cooler/freezer apparatus with nitrogen environment container (U.S. Pat. No. 5,598,713: Bartilucci; A. R.).

All of the above apparatus are characterized by the ability to cool or freeze perishable material down to about the temperature of approximately −20 degrees C. This is adequate and even desirable for some applications. However, for materials that require super freezing at temperatures of approximately −60 degrees C. such apparatus are unable to fulfill the requirements. The inability of the aforementioned apparatuses to maintain the super frozen temperatures is exacerbated by their use of two separate compartments. In this regard, the first of these compartments typically contains the perishable material, while the second of these compartments contains the cooling agent ($CO_2$ or $N_2$). Cooling is accomplished by the cooling agent moving from the second to the first compartment via a venting system.

The aforementioned U.S. Pat. No. 6,003,322 (the '322 patent) was able to achieve the desired superfrozen temperatures, in part by depositing the cooling agent (e.g., $CO_2$ snow) directly on the product, for enhanced heat transfer from the product to the refrigerant. However, the snow covering the product tends to be an encumbrance for personnel working in the container. Moreover, the gaseous form of the cooling agent, e.g., $CO_2$ sublimated from $CO_2$ snow must be removed from the cargo compartment prior to entry by workers. This gas is not easily reclaimed and thus this greenhouse gas is generally released into the environment rather than being recycled for future use.

It is thus desirable to provide a device and method for enabling shipment of product in conventional bulk shipping containers on board conventional shipping vessels at a steady state super-frozen temperature, without the need for enabling the cooling agent to enter the compartment containing the product.

SUMMARY

In one aspect of the invention, a refrigerated container capable of maintaining super frozen temperatures of about −50 degrees C. or less, includes container walls insulated to a value of at least about r-20, a cargo compartment configured for receiving cargo, and at least one refrigerant compartment configured for receiving refrigerant in the form of $CO_2$ snow. The refrigerant compartment maintains the $CO_2$ snow and vapor sublimating therefrom separately from the cargo compartment. In addition, the refrigerant compartment is located within the cargo compartment and configured to permit ambient atmosphere within the cargo compartment to contact at least three sides of the refrigerant compartment. The placement of the refrigerant compartment is also configured to generate a temperature gradient within the cargo compartment capable of generating convection therein, to maintain the super frozen temperatures within the cargo compartment without the use of external power sources.

An another aspect of the invention, a method for maintaining cargo in a refrigerated state for extended periods of time without the need for external power, includes providing a refrigerated container as recited in the preceding aspect, and supplying $CO_2$ snow to the refrigerant compartment. The method further includes loading cargo into the cargo compartment, and sealing the cargo compartment to permit convection to occur between surfaces of the refrigeration compartment and cargo disposed within the cargo compartment.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
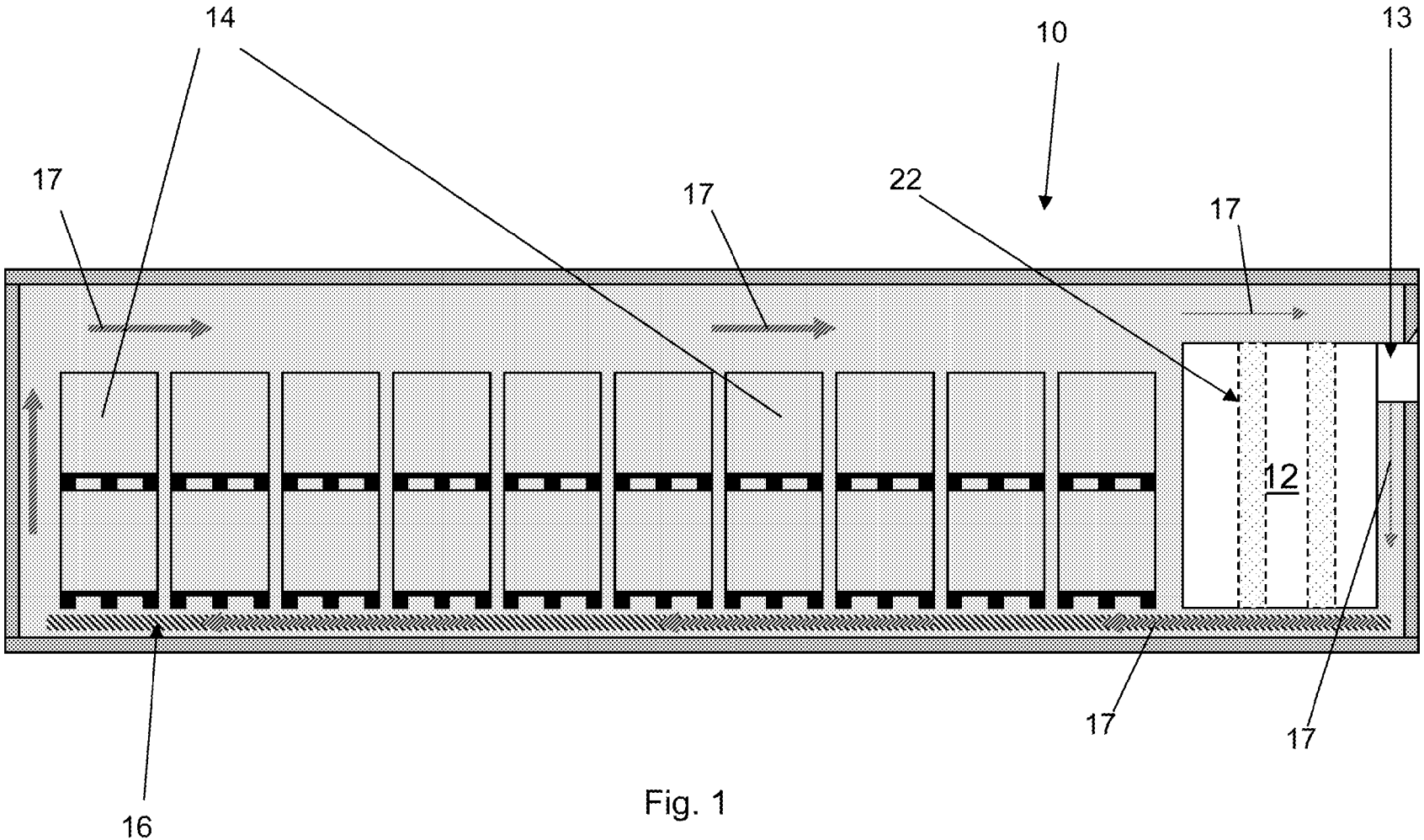
FIG. 1 is schematic cross-sectional elevational side view of an embodiment of the subject invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Where used in this disclosure, the term "axial" when used in connection with an element described herein, refers to a direction relative to the element, which is substantially parallel to the longitudinal dimension of the container of FIG. 1.

An aspect of the present invention was the realization that while it would be beneficial to isolate the refrigerant gas from the cargo area of a shipping container, doing so would tend to reduce the efficiency of thermal transfer between the refrigerant and the cargo. It was further realized that due to this less efficient heat transfer, approaches such as simply using an internal partition to divide the container into separate cargo and refrigerant compartments, generally would be incapable of achieving and maintaining super frozen temperatures without the use of relatively complex active (e.g., electric fan- or pump-based) approaches.

The instant inventors also realized that, particularly when using conventional 40 foot ISO shipping containers, a ceiling mounted bunker would be capable of separating the refrigerant from the cargo, but at the cost of reduced ceiling height. The lowered ceiling height would make it difficult to load cargo in a conventional manner (e.g., using forklifts and the like) via door 50 located at one end of the container. Also, the weight of such an overhead bunker with a desired load of $CO_2$ snow presented structural difficulties of supporting the weight from the container side walls.

Various embodiments of the present invention will now be described with reference to the associated Figures. Turning to FIG. 1, the inventors addressed the aforementioned issued and drawbacks by providing a container 10 with a passive refrigeration technology that does not require any electromechanical devices to achieve and maintain the aforementioned super frozen temperatures. In particular embodiments, the container is provided with a self-contained bunker 12 located, in this example, at the front end of the container 10, that is isolated from the remainder of the container, i.e., from the cargo area 14. The bunker is thus configured to receive refrigerant (e.g., $CO_2$) therein, via duct 13, without enabling the refrigerant (e.g., the $CO_2$ sublimating from the $CO_2$ snow) to enter the cargo area.

The bunker 12 is supported by the container floor, optionally on T-Floor or palletized base 16 to provide an air gap beneath the bunker as discussed in greater detail hereinbelow. The bunker 12 is spaced from the container on at least three sides (one of which may be the floor via the T-floor/pallet arrangement). This spacing permits ambient atmosphere within the cargo compartment to pass along at least three sides of the bunker to facilitate convective heat transfer as shown by arrows 17. This provision for convective heat transfer, in addition to the conductive heat transfer through the bunker walls and supports, provides enhanced heat transfer which enables super frozen temperatures to be maintained throughout the container 10 in many applications, without the use of active heat transport means such as pumps, etc.

Figure 3:
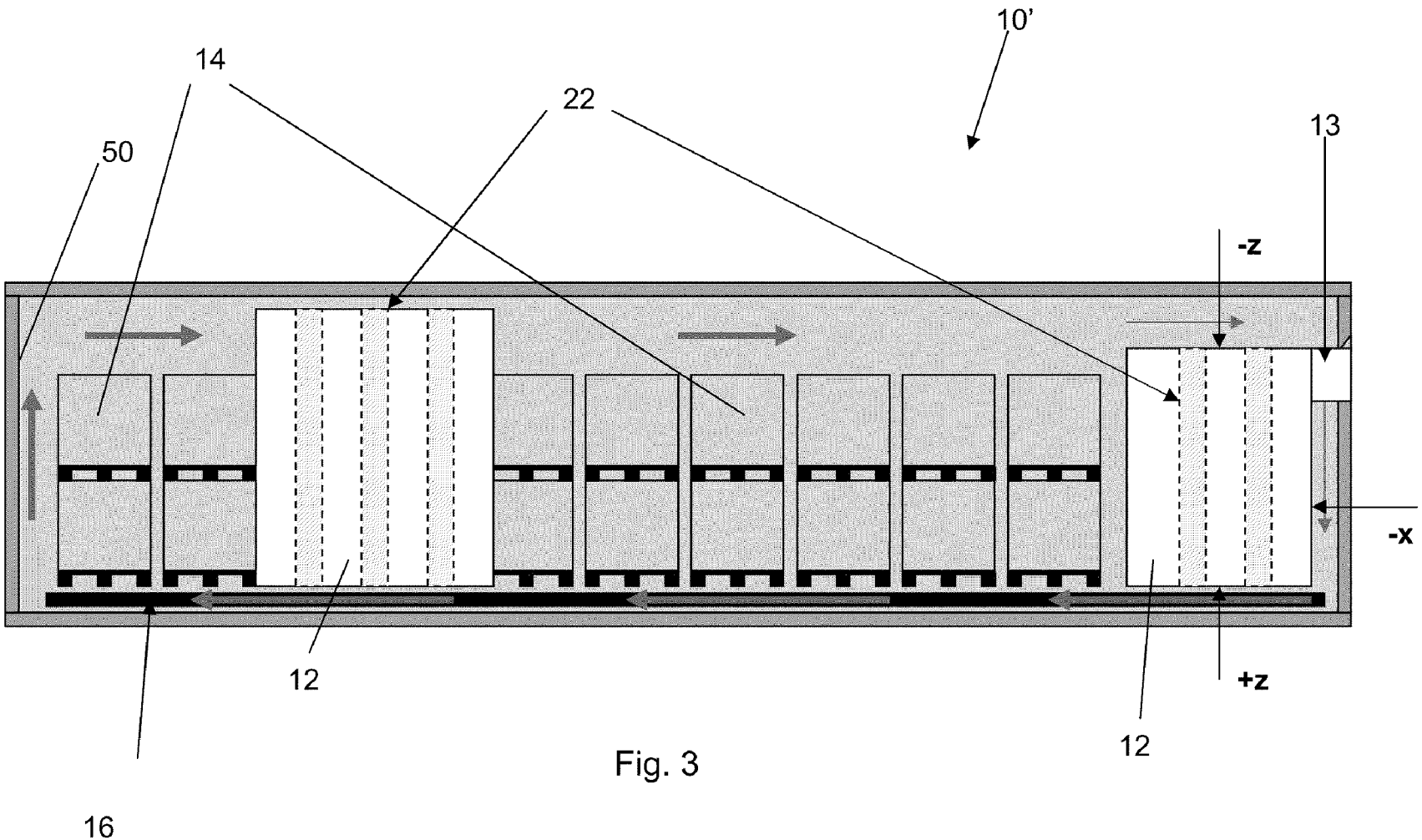
FIG. 3 is a view similar to that of FIG. 1, or an alternate embodiment of the subject invention.
Figure 4:
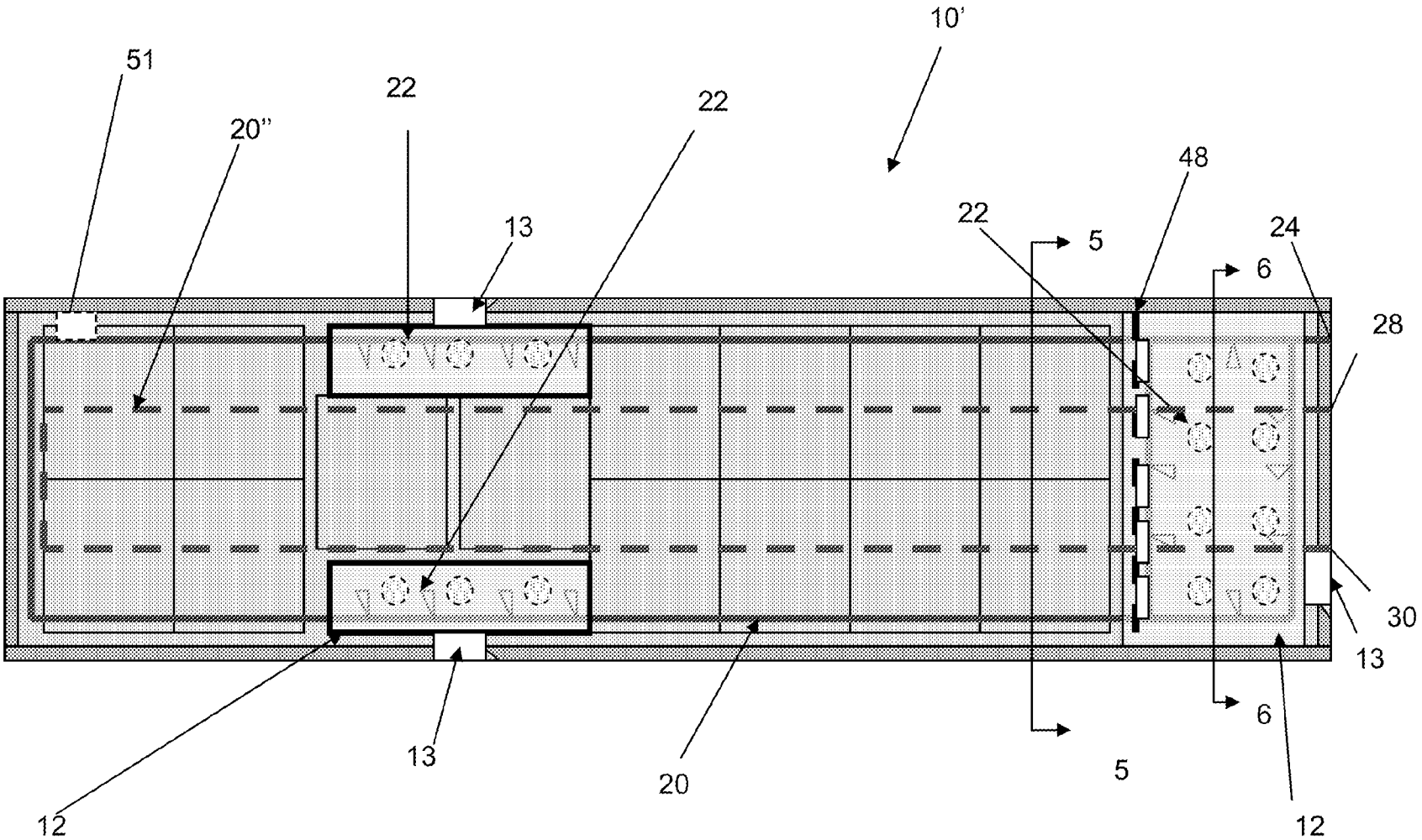
FIG. 4 is a plan view of the embodiment of FIG. 3.

In the embodiments shown, the sides of the bunker(s) are substantially planar, so that the at least three sides discussed above are substantially orthogonal or parallel to one another. It should be recognized, however, that the three sides need not be planar, but rather, may be curved, bent or otherwise angled, provided they expose the bunker to the atmosphere within the container from at least three directions that are either opposite or orthogonal to one another. For example, the embodiment of FIG. 3 provides such exposure from at least the +z, −z, and −x directions as shown. It should also be recognized that the embodiments of FIGS. 1, 3 and 4 provide such exposure on all six sides (i.e., from the +x, −x, +y, −y, +z, and −z directions) of the bunkers 12 for enhanced convective heat transfer.

In a typical example, container 10 may be provided with the exterior dimensions of a conventional forty-foot ISO shipping container. The refrigerant bunker 12 may extend about five to six feet along the axial dimension (length) of the container 10, e.g., from the front end as shown. In this example, about 34 to 35 feet in length would remain available for cargo 14 in the cargo portion of container 10 as also shown. However, it should be recognized that the size of the bunker may vary depending on the length of the journey, i.e., the length of time the container is expected to maintain the desired refrigerated temperature before refilling the bunker with refrigerant.

Since the $CO_2$ snow and the vapor sublimating therefrom is substantially prevented from moving from the bunker 12 to the cargo portion of the container, the cargo would be free of $CO_2$ snow and the atmosphere within the cargo compartment should remain breathable. Moreover, this approach would allow for conventional double stack boxes 14 in the cargo area, since the instant bunker system would not impose any height limitations, such as would be associated with the use of conventional ceiling bunkers.

Another advantage of this approach is that the amount of $CO_2$ supplied to container 10 may be easily measured, e.g., by measuring the height of the $CO_2$ snow within the bunker. This substantially eliminates the need to use the conventional, relatively cumbersome, weight-based approach in which the entire container 10 is weighed before and after supplying the $CO_2$ snow. The height of the $CO_2$ snow in bunker 12 may be determined by the use of optional sensors 18 (FIG. 2) placed within the bunker. Based on this height measurement, the amount of $CO_2$ snow may be determined based upon the known dimensions of the bunker 12.

Figure 2:
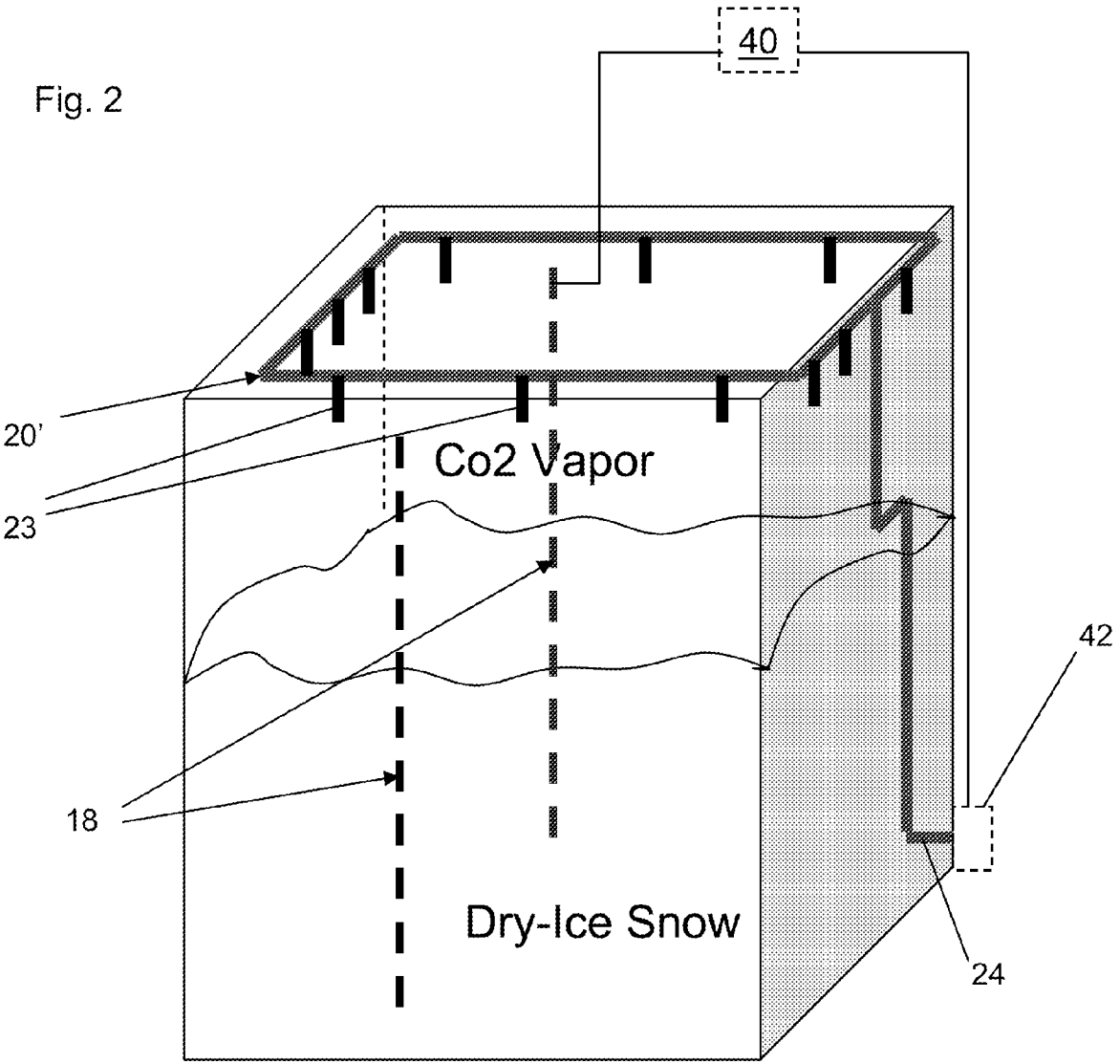
FIG. 2 is a schematic perspective view, with hidden or optional aspects shown in phantom.

It should be recognized that substantially any type of sensor 18 may be used. For example, a series of temperature detectors (e.g., Resistive Temperature Detectors, "RTD"s) may be spaced vertically at predetermined heights along the walls of bunker 12 as shown in FIG. 2. The inventors have observed that temperature sensors will indicate a temperature of −77 C when exposed to $CO_2$ snow, and of −60 C or higher when it is only exposed to $CO_2$ vapor. Since the heights of the sensors are known, this difference in detected temperature may be readily used to determine the depth of the $CO_2$ snow within the bunker.

With reference again to FIG. 1, it should be appreciated that by placing bunker 12 at one end of the container 10 (and/or by placing a series of bunkers 12 in axially or horizontally spaced relation therein, as shown in FIGS. 3, 4) a temperature gradient is generated between the portion of the container where the bunker is located, and the other end/portions. For example, the temperature may be −65 degrees C. at the bunker end, and (initially) substantially higher at the other end. Embodiments of the present invention use this gradient, in combination with the exposure of at least three sides of the bunker(s) to ambient atmosphere within the cargo area, to generate thermal convection within the container. This configuration thus permits both thermal conduction from the bunker towards the other end, e.g., through both the structure of the bunker and container, and also convection via atmosphere cycling through the container passing over the exposed surfaces of the bunker. In this regard, it will be recognized that convection may occur passively, i.e., without added power, as colder air tends to fall and is drawn along the floor towards the warmer portions of the container. This warmed air then rises and returns back to the bunker where it is then cooled and repeats the cycle.

Turning now to FIGS. 3 and 4, in a variation of the foregoing embodiment, it should be recognized that any number of bunkers 12 may be used. For example, for enhanced temperature distribution, a container 10' may be provided with three bunkers at spaced locations within the container as shown. These bunkers 12 may each be provided with their own ducts 13 (FIG. 4) for filling and emptying the $CO_2$, or they may all be filled (and/or emptied) using a single header pipe 20, such as shown in FIG. 4. In this embodiment, three bunkers 12 are shown, although substantially any number may be used while remaining within the scope of the present invention. As shown, one bunker is located at the front of the container and the other two are approximately two thirds of the way to the rear on either side of the container. The location, size and number of these bunkers can change with the requirements of the customer and their products. For example, the temperatures achieved and the duration of storage/shipment can be changed with different configurations.

The bunkers 12 are configured to provide a relatively large surface area in contact with the dry ice ($CO_2$) snow disposed therein, while the aforementioned air gaps on at least three sides (i.e., all sides in the embodiment of FIGS. 3, 4) of the bunkers helps ensure that most of that large surface area is also in contact with the atmosphere within the cargo area 14 of the container. This is provided by sizing and shaping the bunkers to have a relatively large surface area relative to the volume enclosed thereby. (This large surface area to volume ratio may be adjusted as necessary in order to hold a volume of $CO_2$ that is large enough to refrigerate the container to the desired temperature for a desired amount of time between refilling with $CO_2$.) This relatively large surface area helps to maximize the heat transfer between the dry ice and the cargo area within the container, in order to achieve the desired temperatures, which, as discussed above, may be as cold as superfrozen temperatures of −50 degrees C. or less. In this regard, the inventors recognized that the greatest refrigeration effect provided by the $CO_2$ is obtained from the phase change of $CO_2$ from solid to gas. Thus, exposing the cargo area to the point where this phase change is occurring (i.e., at the surface of the bunker) tends to have the highest impact on the compartment's temperature. This bunker configuration, in combination with insulating the walls of container 10, 10' to an r-value of at least about 20 to 30, as discussed in the above-referenced '322 patent, enables the container 10 to maintain super-frozen temperatures in many applications.

In particular embodiments, the walls of the bunker(s) 12 (including those of any hollow shafts 22, discussed below) define a first surface area, while the walls of the cargo compartment define a second surface area, with the ratio of first surface area to second surface area being at least about five percent. In other embodiments, a ratio of at least about ten percent, or even twenty percent or more may be desired.

As mentioned, optimal use of these surface area ratios may be achieved by exposing as much of the bunker surface area as possible to the ambient atmosphere within the cargo area 14. In the embodiment shown, a particularly high exposed surface area is achieved by effectively suspending the bunkers 12 in spaced relation from the walls, ceiling, and floor of the container 10'. This provides air gaps that permit air to flow along the bottom, top, and four sides of each bunker. To further increase surface area of the bunker that is exposed to the container atmosphere, optional hollow shafts 22, which are open at each end, may be disposed to extend (e.g., vertically as shown) through the bunkers 12, so that container atmosphere may flow therethrough. These shafts may be of substantially any desired dimensions.

As mentioned above, an air gap may be provided beneath the bunker(s) 12 by placing the bunkers on a T-Floor or palletized base 16. For example, referring to FIG. 5, T-Floor 16 may include a series of parallel, T shaped rails spaced from one another (e.g., by at least about 1-5 inches) to allow air to circulate between the rails, e.g., to enhance convective heat transfer with the bottom of the bunker. Additionally, these T shaped rails may be fabricated from a relatively thermally conductive material such as various metals, to facilitate thermal transfer with the bunker. Optionally, the T shaped rails may be extended further along the floor of the container (e.g., beyond the footprint of the bunker(s) in the axial direction), to effectively extend the aforementioned thermal conduction (and associated air flow along the rails to the container atmosphere) further from the bunker.

It should be recognized that the temperatures achieved and the rate at which these temperatures are reached is determined, in part, by the amount of surface area of the bunkers that is in contact with the dry ice snow on one side, and exposed to the cargo container on the other. Additional factors include the size and shape of the bunkers and/or the amount of dry ice injected into the bunkers. These factors may thus be varied as desired, to effectively tailor the container 10, 10' for particular applications. As mentioned above, examples of containers 10, 10' may achieve and maintain temperature levels ranging from −65 C to 0 C by varying the size, positioning and surface area exposed by the bunkers. In this regard, the exposed surface area of the bunker may be adjusted by the use of insulation over portions thereof.

Additionally, in particular embodiments, those skilled in the art will recognize, in light of the teachings hereof, that temperatures within the container may be adjusted by changing the size of the air gaps between the bunker and the containers, such as by moving the bunkers and/or blocking a portion of the air gaps; blocking some of the air shafts 22 (if used); placing insulation along portions of the bunker(s) 12; and/or using a piping system (e.g., header 20, FIG. 4) to move the sublimating $CO_2$ vapor through the cargo compartment before exiting the container.

Referring now to FIGS. 4 and 2, in various embodiments, a spray header 20, 20' may be used to inject liquid refrigerant ($CO_2$) into the bunkers 12. A single header 20 may be used to fill a series of bunkers, as shown in FIG. 4, or alternatively, each bunker may have its own header 20' as shown in FIG. 2. A refrigerant supply may thus be connected to header connection port 24 accessible from the exterior of the container 10, 10', to inject liquid $CO_2$ through the header 20, 20 and into the bunker(s) 12 via nozzles 22 (FIG. 2). Ducts 13 may then be used to vent air from bunkers that is being replaced with the refrigerant. Once the $CO_2$ injection is complete, ducts 13 may be closed (via doors or valves, not shown) and secured stopping gases from moving in to or out from the bunker therethrough. Then, $CO_2$ vapor sublimating from the $CO_2$ solid (snow) would be vented back through the nozzles 22 and the header 20, 20' and to port 24. The vapor venting through port 24 may then be conveniently routed away from the container, e.g., via hose or pipe. The vapor may thus be safely vented and/or collected for re-use at a later date. Routing and/or collecting the sublimating vapor in this manner may enable the containers 10, 10' to be placed in confined spaces, such as for use as an indoor freezer or below deck frozen storage on ships. In addition, the routing of sublimating refrigerant vapor back through the header 20, 20' advantageously tends to enhance cooling within the container 10, 10', since the sublimating $CO_2$, for example, has a temperature of about −60 C. The headers 20, 20' may thus act as a heat exchanger that serves to help refrigerate the container 10, 10' as it passes therethrough. In this regard, the piping size and/or configuration of the headers 20, 20' may be adjusted for enhanced heat transfer, such as by adding radiator fins or other heat exchanger configurations such as extra fluid flow loops within the cargo area 14.

It should be recognized that the number of nozzles may be determined by the size and positioning of the bunkers. Even though the piping system runs through the cargo space, the bunkers are sealed and the nozzles only spray within each bunker, so that the cargo area 14 remains substantially free of the refrigerant.

Optionally, an additional pipe 20", similar to header 20, but without nozzles 22, may circulate through the container between inlet and outlet 28 and 30, respectively. This optional pipe may be connected to a refrigerant supply and return, to circulate a refrigerant such as $CO_2$ or Nitrogen ($N_2$). Pipe 20" may thus be used as an optional refrigeration means, such as when container 10 is used for long term storage.

Figure 6:
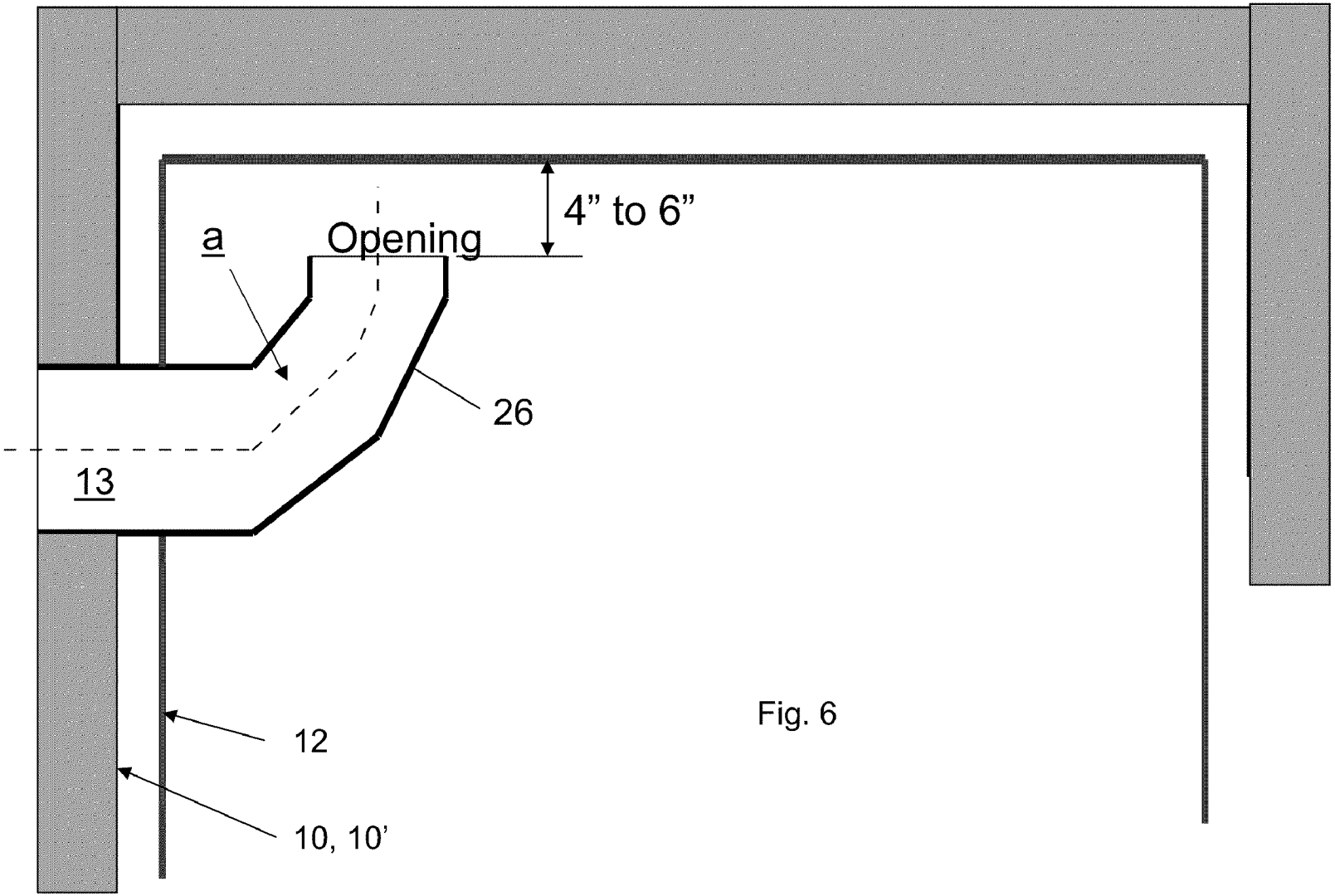
FIG. 6 is a cross-sectional view taken along 6-6 of FIG. 4, of another optional aspect of the subject invention.

Turning now to FIG. 6, in another variation, the ducts 13 any of the various embodiments discussed herein may be equipped with a contoured conduit (baffle) 26. In this variation, instead of opening directly into the bunker, the duct 13 opens to the bunker 12 via a contoured conduit that terminates at a distal end disposed proximate the top of the bunker. In exemplary embodiments, the distal end terminates within about 4 to 6 inches of the ceiling of the bunker 12 as shown. As also shown, in particular embodiments, the conduit is configured to define a longitudinal axis a that is bent, to form a bent or substantially curved flow path for escaping gas. In particular embodiments, the flow path has the equivalent of at least one 90 degree bend as shown. This bend or curvature, in combination with the placement of the distal end close to the top of the bunker, is used to reduce the amount of $CO_2$ snow and/or liquid that is undesirably carried out through the vent as the bunker is filled with $CO_2$.

In this regard, it is noted that during $CO_2$ filling operations, as the level of $CO_2$ snow in the bunker approaches the level of duct 13 (without conduit 26), snow may be undesirably blown out the duct 13 by the high velocity, escaping gas. Orienting the distal opening of the conduit upward as shown, tends to lessen this effect by making it more difficult for the snow/liquid to reach the duct. In particular, the distal opening may be placed higher within the bunker (e.g., within 4 to 6 inches of the ceiling as shown) than the duct 13 to permit the snow to be piled up to and even deeper than the duct 13, without appreciable loss of snow therethrough. The upwardly opened distal end also effectively requires any escaping snow/liquid to be carried upward against the force of gravity in order to enter the conduit 26, to further discourage such venting. Still further, those skilled in the art of fluid dynamics will recognize that fluid flow through a bent conduit is restricted relative to that of a straight conduit. As such, the curvature (bent axis a) of conduit 26 tends to add resistance to the flow of fluid therethrough, to reduce the velocity of escaping material. This aspect of the conduit 26 may thus calm the flow of escaping $CO_2$ gas to further reduce the tendency of $CO_2$ snow (and/or liquid $CO_2$) to be blown out duct 13.

Those skilled in the art should recognize that although a curvature of 90 degrees is shown and described, substantially any curvature may be used without departing from the scope of the invention. It should further be noted that conduit 26 may be provided with substantially any configuration that provides for indirect flow of the $CO_2$ vapor from the bunker. For example, a substantially straight conduit angled upward from the horizontal towards the ceiling, would be expected to provide beneficial effects as discussed herein.

The aforementioned embodiments may be used in any number of applications. For example, the containers 10, 10' may be of substantially any convenient size and shape, such as any number of standard ISO (International Standards Organization) shipping container sizes, including ISO 20 foot, ISO 40 foot, ISO 20 foot high-cube, and ISO 40 foot high-cube. As a non-limiting example, although the aforementioned embodiments have been shown and described as relatively large (e.g., 40 foot) ISO shipping containers of the type commonly used for ship or rail transport, the containers may be configured in other sizes, such as conventional LD3 air freight containers, for convenient transport by air. Moreover, it should be recognized that the containers 10, 10' may be fabricated with substantially any size and shape, movable or non-movable, without departing from the scope of the present invention.

For example, the containers 10, 10' may be used for long-term storage in which cargo placed in the container may be maintained at refrigerated temperatures indefinitely by repeatedly supplying $CO_2$ to the bunkers 12. Similarly, the containers 10, 10' can be used for active storage where product is placed in storage for varying amounts of time and personnel are entering and exiting periodically to add and retrieve product. This may also continue indefinitely with ongoing $CO_2$ shoots to replenish the refrigerant. It is noted that these approaches may be conveniently enhanced with automated controls, e.g., coupled to sensors 18, so that additional $CO_2$ is automatically added to the bunkers when the snow reaches a predetermined level. For example, referring back to FIG. 2, as shown in phantom, an optional microprocessor 40 may be used to electrically actuate a valve 42 coupled to port 24 to automatically open to supply $CO_2$ to header 20' in response to signals captured from sensors 18 indicating that the level of snow within bunker 12 has fallen to a predetermined lower level. Similarly, processor 40 may be configured to close valve 42 once the $CO_2$ snow has reached a desired predetermined upper level.

Additionally, the container 10, 10' may be used in an intermodal manner. It may be shipped in substantially any manner, e.g., by train, ship, truck, airplane, etc., to a remote location and can either be unloaded immediately or it may be converted to either or both of the storage applications discussed above, e.g., by refilling with $CO_2$ for extended storage. Moreover, in some applications, it may be desirable to cool the container 10, 10' to mutually distinct temperatures, such to ship at a colder temperature than during storage, or vice versa. The amount of $CO_2$ in bunkers 12 may thus be selectively increased to achieve the lower temperatures and decreased to achieve higher (yet still freezing) temperature.

It should also be recognized that although it is desired in many applications to maintain the refrigerant outside of the cargo area 14, such is not required. For example, a hybrid approach may be used, in which $CO_2$ is deposited into one or more bunkers 12, while some (e.g., a relatively small amount of) $CO_2$ snow is also deposited directly into the cargo area 14. The $CO_2$ snow in the cargo area may be predetermined based on the length of the expected transit, so that the snow will have sublimated by the time the container arrives at a destination, or the storage period is over. Then there would be substantially no snow remaining in the cargo portion, to facilitate unloading, etc., but there is still some snow left in the bunker to maintain the desired temperature during this loading/unloading.

There may still be some $CO_2$ vapor in the cargo area 14 of the container when it arrives at its destination, or when storage ended. However, once the door was opened and the $CO_2$ vapor vented, there would no longer be a continuing source of $CO_2$ vapor in the cargo compartment from sublimating $CO_2$ snow, since the snow all would have sublimated. However, the $CO_2$ snow in the bunker would continue to refrigerate the container.

As yet another option, the bunker(s) 12 may be configured with a movable wall, depending on the application. For instance, when shipping within the United States (i.e., with a shipment duration of about one week or less, the bunker would not need to be as large as for overseas shipments of longer duration. The bunker may thus be optionally fabricated as a telescoping structure, in which a wall is configured to be movable in the axial direction to selectively enlarge and decrease the volume of the bunker as desired. Any suitable structure known to those skilled in the art may be used to provide this telescoping structure, such as a series of rails that enable a bunker wall to be slidably moved (e.g., in the axial direction) within the remaining walls of the bunker.

Figure 7:
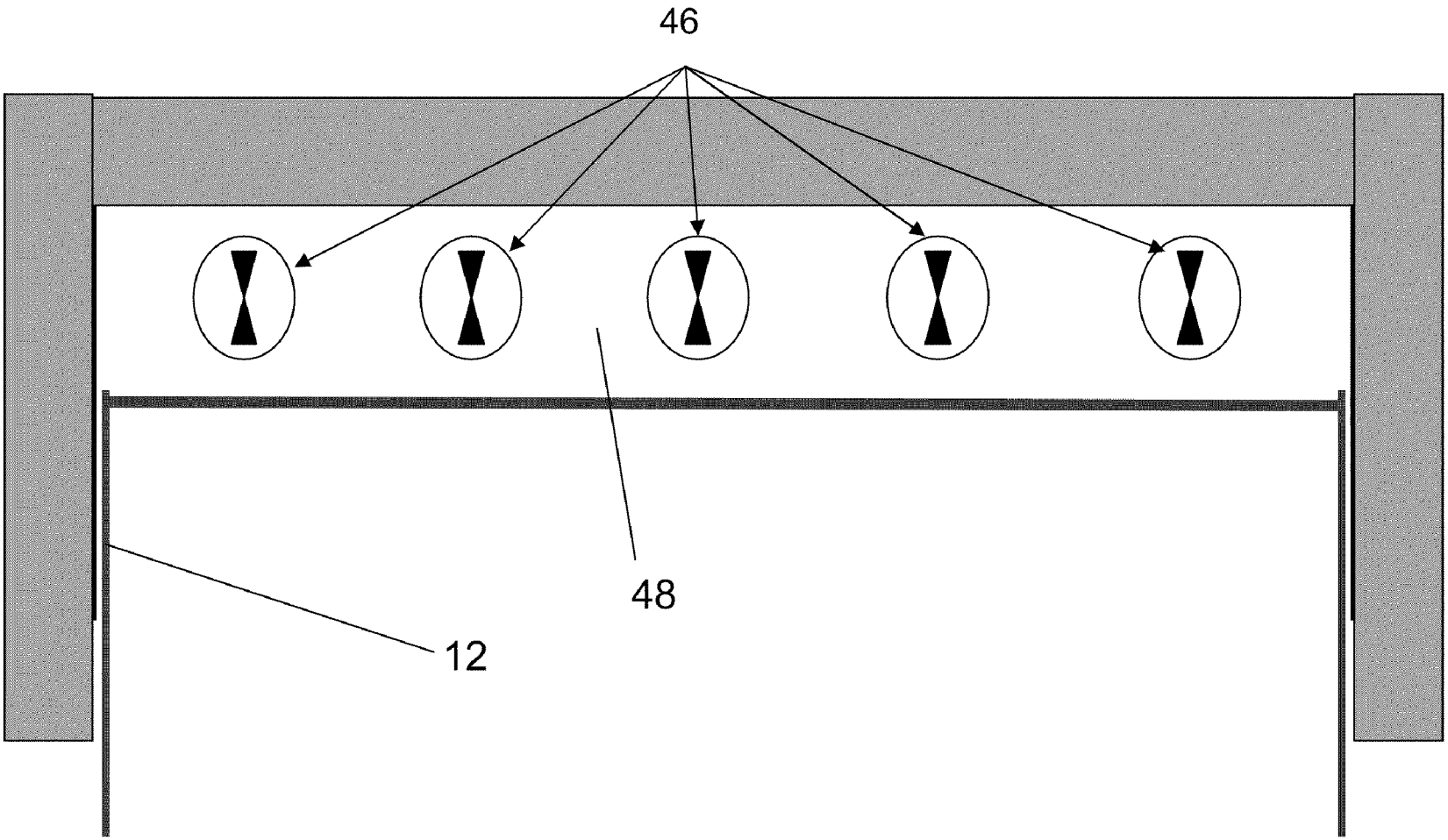
FIG. 7 is a view similar to that of FIG. 5, of yet another optional aspect of the subject invention.

As discussed above, various embodiments of the present invention are substantially passive, e.g., to effectively provide 'dry' containers, which do not need to be plugged into an external energy source in order to maintain refrigerated temperatures during shipment or storage. (In this regard, sensors 18, processor 40 and valve 42 may be powered, e.g., by battery, to take snow measurements prior to shipping or storage, but the desired temperature would still be maintained passively.) However, it should be understood that any of the embodiments discussed herein may be optionally equipped with one or more active heat transfer elements, such as in the event power is available, e.g., by either battery, generator or line power. For example, as shown in FIG. 7, one or more fans 46 (e.g., electrically operated) may be disposed within the container 10, 10' to enhance the natural convection therethrough for potentially increased refrigeration efficiency. Operation of fans 46 may be controlled by processor 40 (FIG. 2) which may be configured to cycle the fans on and off at predetermined intervals, or optionally, in response to drops in temperature within the cargo area 14 such as determined by temperature sensor (e.g., Resistive Temperature Detector "RTD") 51 (FIG. 4). As also shown, the fans 46 may be conveniently disposed within a buffer plate 48 that extends within an air gap between bunker 12 and the ceiling of the container. Plate 48 (and fans 46) may thus be configured to be conveniently removed when not needed (such as for relatively short duration shipments or storage) as a unitary device.

Still further options that may require external power (by battery or otherwise) include the use of one or more oxygen monitors. An oxygen monitor may be disposed within the cargo area 14 and configured to generate an alarm in the event there is insufficient oxygen within the cargo area for personnel to safely enter.

Various embodiments discussed herein may advantageously provide a mechanism for making use of recycled carbon dioxide. In this regard, an ever increasing number of industrial processes, including electrical power generation, are being required to capture, rather than release, potential greenhouse gases such as $CO_2$. These embodiments make use of this recycled carbon dioxide as a refrigerant, substantially without the release of new carbon dioxide into the atmosphere, as would occur if conventional compressor-based refrigerators, powered by fossil fuels, were used to create a cold environment.

Turning now to Table I, a representative method in accordance with the teachings of the present invention is described. As shown, a method for maintaining cargo in a refrigerated state for extending periods of time without the need for external power, includes 100 providing a refrigerated container such as shown and described hereinabove in FIG. 1. At 102, $CO_2$ snow is supplied to the refrigerant compartment. At 104, cargo is loaded into the cargo compartment. At 106, loading 104 is optionally accomplished after the supplying 102. At 108, the cargo compartment is sealed to permit convection to occur between surfaces of the refrigeration compartment and cargo disposed within the cargo compartment. At 110, the container is optionally shipped as a dry container. At 112, the refrigerant compartment is optionally coupled to a $CO_2$ supply and automatically supplied with $CO_2$ in response to measured levels of $CO_2$ in the refrigeration compartment. At 114, the container is optionally provided with a refrigerant supply conduit configured as a heat exchanger, which passes through the container from an inlet to an outlet, and at 116, a refrigerant supply is coupled to the inlet and a refrigerant return is coupled to the outlet to refrigerate the container.

TABLE I

| | |
|---|---|
| 100 | provide a refrigerated container as per FIG. 1 |
| 102 | $CO_2$ snow is supplied to the refrigerant compartment |
| 104 | cargo is loaded into the cargo compartment |
| 106 | Optionally, loading 104 is accomplished after supplying 102 |
| 108 | cargo compartment is sealed to permit convection |
| 110 | Optionally, container shipped as a dry container |
| 112 | Optionally, refrigerant compartment coupled to a $CO_2$ supply and automatically supplied with $CO_2$ in response to measured levels within refrigeration compartment. |
| 114 | Optionally, container provided with a refrigerant supply conduit configured as a heat exchanger, which passes through the container from an inlet to an outlet |
| 116 | Optionally, refrigerant supply coupled to the inlet and a refrigerant return is coupled to the outlet to refrigerate the container |

The following illustrative example demonstrates certain aspects and embodiments of the present invention, and is not intended to limit the present invention to any one particular embodiment or set of features.

EXAMPLE

Example 1

Figure 5:
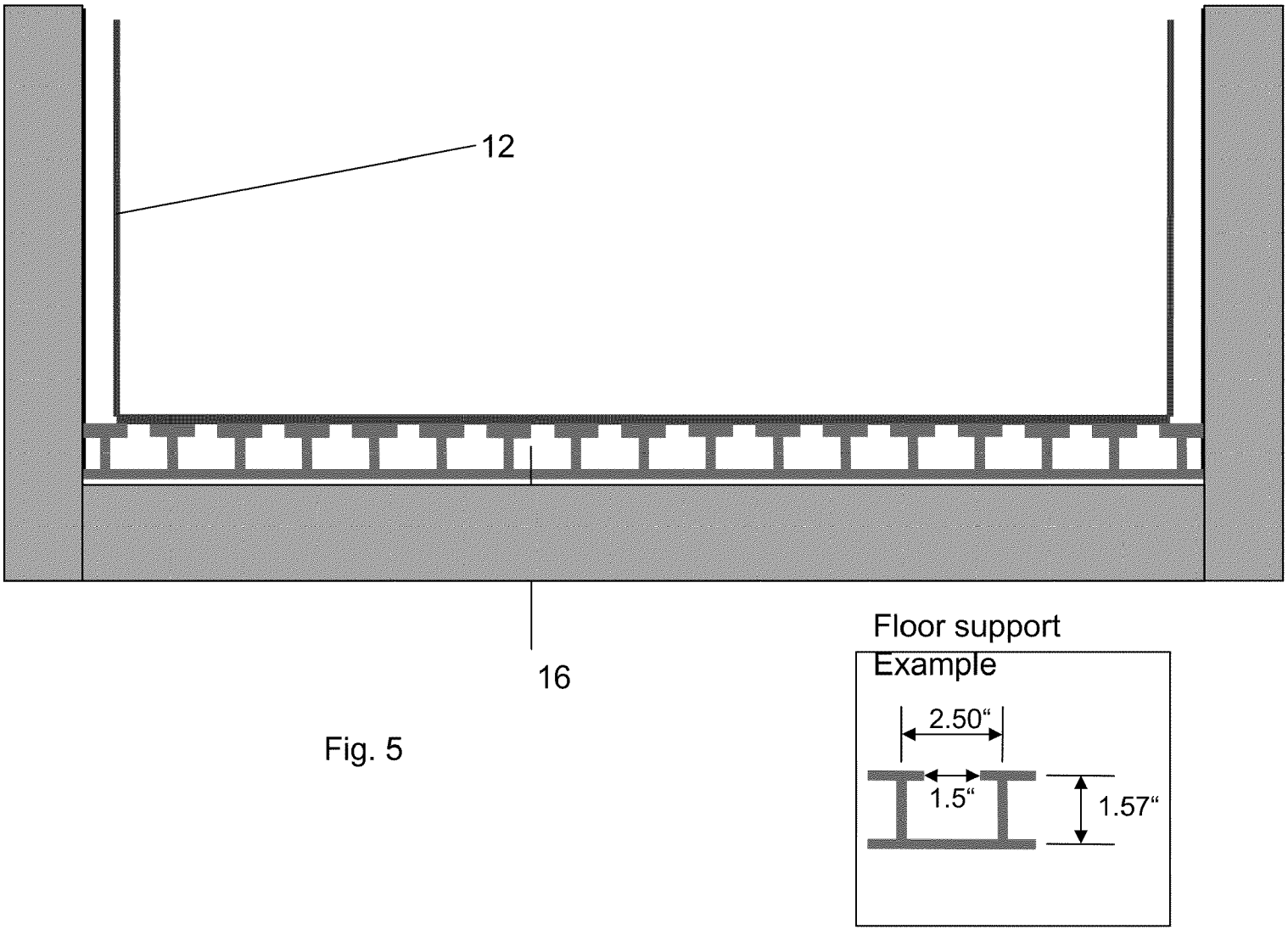
FIG. 5 is a cross-sectional view taken along 5-5 of FIG. 4, of an optional aspect of the subject invention.

A container as shown in FIGS. 5, 3 and 4, (without the optional air circulation shafts and Nitrogen refrigerant loop 20") was built according to the following parameters. This exemplary container was tested and found to successfully bring the temperature within the container down to less than −50 degrees C.

Internal Dimensions of Container:
38' 9⅞" long
6' 11⁵⁄₁₆" wide
8' 0" high
The Dimensions of the Two Rear Bunkers:
96" long
18" wide
90" high
space between the wall and the bunkers=2"
space between the two bunkers 43"+
The bunkers are positioned 58" from the rear door
The Dimensions of the Front Bunker:
51" deep
77" wide
90" high with T floor
space between ceiling and bunker=6"
space between walls and sides=3"
space between front wall and front of bunker=3"
Other Dimensions:
space between bunkers and front bunker=294"

In this example, the refrigerant compartments define a total first surface area of about 225 square feet, and the cargo compartment defines a second surface area of about 1275 square feet, for a ratio of first surface area to second surface area of about 18 percent.

It should be recognized, however, that this ratio may be substantially less, e.g., in the event that higher temperatures were desired within the cargo area. Moreover, smaller bunkers may be more advantageous than larger bunkers of the same surface area, e.g., when used for relatively short shipping distances, since they would tend to require less $CO_2$ volume to provide comparable heat exchange surface area. This is because as the as the level of $CO_2$ drops in the bunkers (i.e., as the $CO_2$ sublimates), the effective heat-exchange surface area of the bunkers drops, so that the temperature rises. When using smaller volume bunkers, a lower volume of $CO_2$ provides a higher heat-exchange surface area, so that less $CO_2$ may be used to achieve the desired temperature, albeit for shorter periods of time.

At these ratios, the cargo compartment is maintained at superfrozen temperatures of −50 degrees C. as long as the refrigerant containers remain filled with $CO_2$ to at least 25 percent of their capacity.

An otherwise similar container having a ratio of first surface area to second surface area of about 9 percent is also be provided. This container is capable of maintaining superfrozen temperatures within the cargo area as long as the refrigerant containers are filled at least to 50 percent of their capacity. Similarly, a ratio of 6 percent may be used with refrigerant capacities of at least 75 percent, etc.

It should be understood that any of the features described with respect to one of the embodiments described herein may be similarly applied to any of the other embodiments described herein without departing from the scope of the present invention.

In the preceding specification, the invention has been described with reference to specific exemplary embodiments for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

Having thus described the invention, what is claimed is:

1. A method for maintaining cargo in a refrigerated state for extended periods of time without the need for external power, the method comprising:

(a) providing a refrigerated container including:

container walls insulated to a value of at least about r-20:

a cargo compartment configured for receiving cargo therein;

at least one refrigerant compartment configured for receiving refrigerant therein, the refrigerant compartment configured for receiving $CO_2$ snow therein, wherein the $CO_2$ snow and vapor sublimating therefrom is maintained separately from the cargo compartment;

the refrigerant compartment disposed within the cargo compartment in spaced relation from interior surfaces of the cargo compartment to permit ambient atmosphere within the cargo compartment to contact at least three side of the refrigerant compartment; and placement of the refrigerant compartment within the cargo compartment being configured to generate a temperature gradient within the cargo compartment capable of generating convection within the cargo compartment;

(b) supplying $CO_2$ snow to the refrigerant compartment, wherein the $CO_2$ is maintained separately from the cargo compartment, while exterior surfaces on at least three sides of the refrigerant compartment are exposed to interior space within the cargo compartment;

(c) loading cargo into the cargo compartment, wherein the cargo is cooled by exposure to the exterior surfaces of the refrigerant compartment without the cargo being exposed to the $CO_2$; and (d) sealing the cargo compartment to permit convection to occur between the exposed surfaces of the refrigeration compartment and cargo disposed within the cargo compartment, wherein the container is configured to maintain the cargo at super frozen temperature of about−50 degrees C or less while being free from external power sources.

2. The method of claim 1, further comprising shipping the container as a dry container.

3. The method of claim 1, wherein said loading (c) is accomplished after said supplying (b).

4. The method of claim 1, further comprising coupling the refrigerant compartment to a $CO_2$ supply and automatically supplying $CO_2$ in response to measured levels of $CO_2$ in the refrigeration compartment.

5. The method of claim 1, wherein the container includes a refrigerant supply conduit configured as a heat exchanger, passing through the container from an inlet to an outlet, the method further comprising coupling a refrigerant supply to the inlet and a refrigerant return to the outlet to refrigerate the container.

6. The method of claim 1, comprising supplying $CO_2$ snow to the cargo compartment.

7. The method of claim 1, wherein said providing (a) further comprises the refrigerant compartment being disposed and configured to permit ambient atmosphere within the cargo compartment to contact at least four sides of the refrigerant compartment.

8. The method of claim 7, wherein the refrigerant compartment is disposed and configured to permit ambient atmosphere within the cargo compartment to contact six sides of the refrigerant compartment.

9. The method of claim 8, wherein the sides of the refrigerant compartment are substantially planar.

10. The method of claim 1, wherein said providing (a) further comprises the container being free from any active fluid flow devices.

11. The method of claim 1, wherein said providing (a) further comprises the container configured for being passively refrigerated without the use of electromechanical devices or other external energy input.

12. The method of claim 1, wherein said providing (a) further comprises at least one gas supply pathway extending within the cargo compartment, from an inlet port to the refrigerant compartment.

13. The method of claim 12, wherein the pathway is configured to selectively supply $CO_2$ from the inlet to the refrigerant compartments, and to permit $CO_2$ sublimating from the refrigerant compartments to be vented to the inlet.

14. The method of claim 13, wherein the inlet is configured to enable capture of the $CO_2$ sublimating from the refrigerant compartments.

15. The method of claim 13, wherein the pathway is configured as a heat exchanger to provide thermal transfer between the $CO_2$ and the cargo compartment supply and venting.

16. The method of claim 12, wherein another gas supply pathway extends through the cargo compartment, from another inlet to an outlet, the other gas supply pathway being closed to the cargo compartment, so that gas supplied therethrough is physically isolated from the cargo compartment.

17. The method of claim 16, wherein the other gas supply pathway is configured for being coupled to a liquid nitrogen ($N_2$) supply and return.

18. The method of claim 12, comprising a level sensor configured to generate data corresponding to the level of $CO_2$ within the refrigerant compartment.

19. The method of claim 18, comprising a valve communicably coupled to said inlet, and a processor communicably coupled to said valve and said level sensor, said processor configured to selectively actuate said valve in response to data captured from said level sensor.

20. The method of claim 1, wherein said providing (a) further comprises:

the exposed surfaces of the refrigerant compartment defining a first surface area, and interior surfaces of the cargo compartment define a second surface area, the ratio of first surface area to second surface area being at least about 5 percent.

21. The method of claim 20, wherein the ratio of first surface area to second surface area is at least about ten percent.

22. The method of claim 21, wherein the ratio of first surface area to second surface area is at least about twenty percent.

23. The method of claim 1, wherein said providing (a) further comprises the container including at least one conduit disposed to pass through the refrigerant compartment, said conduit being in fluid communication with the cargo compartment.

24. The method of claim 1, wherein said providing (a) further comprises said refrigerant compartment being supported by the floor of the container.

25. The method of claim 24, wherein said refrigerant compartment is supported on a plurality of rails disposed in spaced relation on the floor of the container, wherein the ambient atmosphere is permitted to pass between the refrigerant compartment and the floor of the container.

26. The method of claim 1, wherein said providing (a) further comprises the container being sized and shaped to ISO (International Standards Organization) standards.

27. The method of claim 26, wherein the container is sized and shaped to ISO standards selected from the group consisting of ISO 20 foot, ISO 40 foot, ISO 20 foot high-cube, ISO 40 foot high-cube, and LD3.

28. The method of claim 1, wherein said providing (a) further comprises the container walls being insulated to a value of at least about r-30.

29. The method of claim 1, wherein said providing (a) further comprises the container including a vent port configured to relieve pressure within the refrigerant compartment during receipt of $CO_2$ therein.

30. The method of claim 29, wherein the container includes a conduit extending from a proximal end communicably coupled to said vent port, to a distal end disposed within the refrigerant compartment, said distal end being vertically offset from said vent port when the container is oriented for receiving $CO_2$ snow therein.

31. The method of claim 30, wherein the distal end is disposed vertically above the vent port.

32. The method of claim 31, wherein the distal end is disposed within about the upper 10 percent of the height of the refrigerant compartment.

33. The method of claim 32, wherein the distal end is disposed within about the upper 4 to 6 percent of the height of the refrigerant compartment.

34. The method of claim 31, wherein the conduit defines a longitudinal axis that is bent to form a bent flow path for escaping gas.

35. The method of claim 34, wherein the longitudinal axis has a total bend of at least 90 degrees.

* * * * *